US005653049A

United States Patent [19]

Motoda

[11] Patent Number: 5,653,049

[45] Date of Patent: Aug. 5, 1997

[54] RESILIENT PAD FOR A FLAT SHEET IRONING MACHINE

[75] Inventor: Shuho Motoda, Koshigaya, Japan

[73] Assignee: San-Ai Industries Inc., Saitama-Pref, Japan

[21] Appl. No.: 627,109

[22] Filed: Apr. 3, 1996

[30] Foreign Application Priority Data

Apr. 3, 1995 [JP] Japan ..... 7-099441

[51] Int. Cl.[6] ..... D06F 83/00

[52] U.S. Cl. ..... 38/66

[58] Field of Search ..... 38/18, 62, 66; 267/106, 103, 75, 150, 131, 168, 170, 179, 272

[56] References Cited

U.S. PATENT DOCUMENTS

| | | | |
|---|---|---|---|
| 1,592,564 | 7/1926 | Hamilton . | |
| 1,924,973 | 8/1933 | Beede et al. | 38/66 |
| 2,190,146 | 2/1940 | Bristol | 38/66 |
| 2,708,322 | 5/1955 | De Frances | 38/66 |

FOREIGN PATENT DOCUMENTS

| | | | |
|---|---|---|---|
| 2625201 | 4/1976 | Germany | 38/66 |
| 5-277300 | 10/1993 | Japan . | |
| 650212 | 2/1951 | United Kingdom . | |

*Primary Examiner*—Ismael Izaguirre
*Attorney, Agent, or Firm*—Young & Thompson

[57] ABSTRACT

A resilient pad for resiliently supporting a felt cover on a rotatable drum of a flat sheet ironing machine, comprises a plurality of helically wound coil springs having an inner end adjacent to the drum and an outer end adjacent to the felt cover, a backing strip windable about the drum and a plurality of plate-like elements connected respectively to outer ends of the coil springs. The inner end of each coil spring is supported by the backing strip with the coil springs spaced apart along the longitudinal extent of the backing strip. Each coil spring has two helically wound portions joined at the outer end of the spring by a transverse portion which is connected to a respective plate-like element, by crimping lugs on the element to the transverse portion or by welding, and each plate-like element has one or more claws on its outer surface for making catching contact with the felt cover to ensure that, in use, the felt cover rotates with the drum.

17 Claims, 5 Drawing Sheets

RESILIENT PAD FOR A FLAT SHEET IRONING MACHINE

INTRODUCTION

This invention relates to a resilient pad for resiliently supporting a felt cover on a rotatable drum of a flat sheet ironing machine and to a flat sheet ironing machine equipped with such a pad.

A conventional flat sheet ironing machine is shown in FIGS. 10 and 11. This ironing machine comprises a bed 21 which is provided with a heater (not shown) and a part cylindrical recess 21*a*, and a cylindrical sheet roller 22 rotatably mounted in the recess 21*a*. The roller 22 comprises a central drum 25 rotatable by a drive shaft 27 and a felt cover 23 resiliently supported on the drum 25 by a plurality of coil springs 24. The roller 22 is urged into contact with the bed 21 by pneumatically operated piston and cylinder units (not shown) at opposite ends of the drum.

When an item 28 to be ironed, such as an item of bedding, e.g. a pillowcase or sheet, or an item of tableware, e.g. a napkin or tablecloth, is passed between the roller 22 and the recess 21*a*, the item is heated by the heater provided in the bed 21 and the evaporated water content from the item passes through the felt cover 23 and enters the drum 25 through holes in the periphery thereof. The evaporated water content is then drawn from one end of the drum by suction.

The coil springs 24 are integrally formed from a continuous length of wire and are supported at their inner ends by a backing strip 26 spirally wound about the periphery of the drum 25. Each spring 24 has two helically wound portions 24*a* and 24*b* joined together at the outer end of the spring by a transverse portion 24*c*.

The outer ends of the coil springs 24 are attached to the felt cover 23 by wire passed through the felt cover and beneath the backing strip or by T-pins pressed through the felt cover and obliquely into the coil springs 24. This is labour intensive and expensive. Also, there can be slippage between the felt cover and the coil springs. In addition, the area of contact between the springs and the felt cover is relatively small. Also, the pressure applied to the felt cover is unevenly distributed and this can result in poor finish quality of ironed items unless a thick felt cover is used. Thick covers add to the costs.

It is also known to provide so-called laminated or plate springs between the drum and the felt cover. These springs comprise a band wound about the drum and a plurality of overlapping plate-like elements integrally connected to the band by outwardly inclined spring leaves. These springs use a lot of material and are expensive to make. Also, the leaves can be permanently deformed by lumps in items to be ironed with the result that the pressure applied to the felt cover becomes unevenly distributed where the springs have been deformed.

The present invention seeks to provide a resilient pad which will resiliently support a felt cover on a rotatable drum of a flat sheet ironing machine and which will largely overcome the drawbacks of known springs.

SUMMARY OF THE INVENTION

According to a first aspect of the present invention, there is provided a resilient pad for resiliently supporting a felt cover on a rotatable drum of a flat sheet ironing machine, the resilient pad comprising a plurality of helically wound coil springs each having an inner end in use adjacent to the drum and an outer end in use adjacent to the felt cover, a backing strip windable about said drum, the inner end of each coil spring being supported by the backing strip with the coil springs spaced apart along the longitudinal extent of the backing strip, and a plurality of plate-like elements having inner and outer faces and being connected respectively to the outer ends of the coil springs, each coil spring having two helically wound portions joined at the outer end of the spring by a transverse portion which is connected to a respective plate-like element and each plate-like element having one or more claws on its outer surface for making catching contact with the felt cover to ensure that, in use, the felt cover rotates with the drum.

Preferably, each plate-like element has positioning means on its inner face for positioning the plate-like element relative to its respective spring. More preferably, each plate-like element has two spaced apart positioning means, one adjacent either end of the transverse portion of the spring. In either case, the or each positioning means may comprise two opposing lugs between which the transverse portion of a respective spring extends. In this case, conveniently, the plate-like elements are secured to the transverse portions of the respective springs by crimping the lugs about the transverse portions of respective springs. Alternatively, or possibly additionally, the plate-like elements are secured to the transverse portions of respective springs by welding.

Advantageously, the transverse portions of the springs extend in a direction parallel to the longitudinal extent of the backing strip.

Preferably, the springs are integrally formed with one another from a continuous length of wire and portions of the wire between adjacent springs pass beneath the backing strip to anchor the inner ends of the springs to the backing strip.

According to a second aspect of the invention there is provided a flat sheet ironing machine comprising a bed having a part cylindrical recess and a roller mounted for rotation in the recess, the roller comprising a drum, a felt cover mounted on the drum and a resilient pad according to the first aspect of the invention between the drum and the cover, the backing strip being wound about the drum and the claws of the plate-like elements being in catching contact with the felt cover.

Preferably, the flat sheet ironing machine further comprises means for urging the roller into contact with the bed.

The invention will now be more particularly described, by way of example, with reference to the accompanying drawings.

DESCRIPTION OF THE PREFERRED EMBODIMENTS

Figure 1:
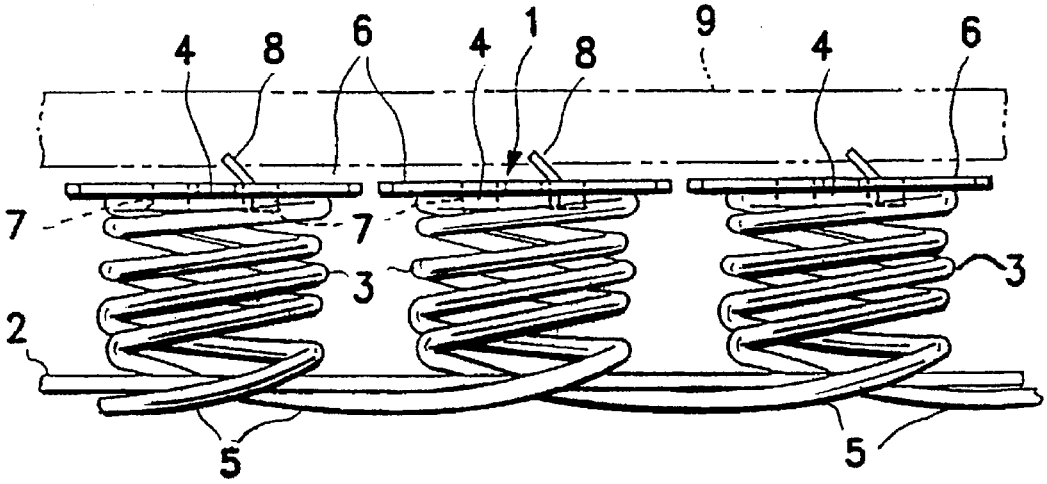
FIG. 1 is a side view of one embodiment of a resilient pad according to the present invention.
Figure 2:
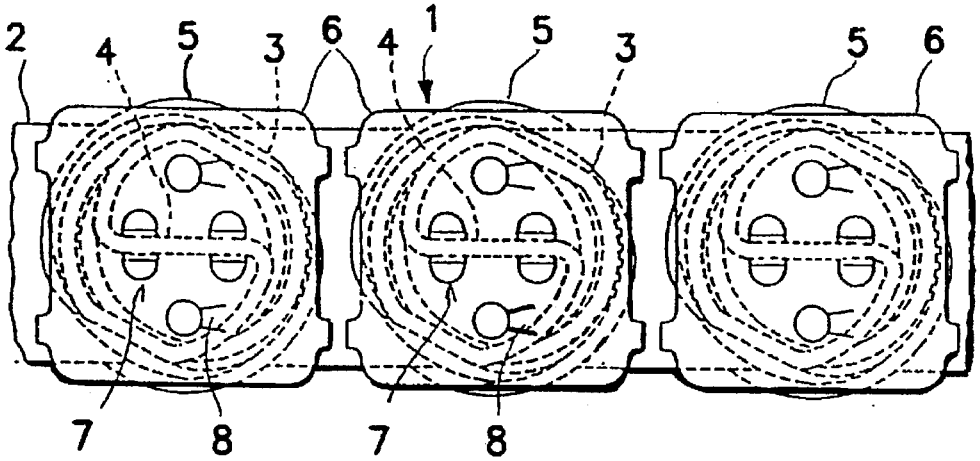
FIG. 2 is a plan view of the resilient pad shown in FIG. 1.
Figure 3:
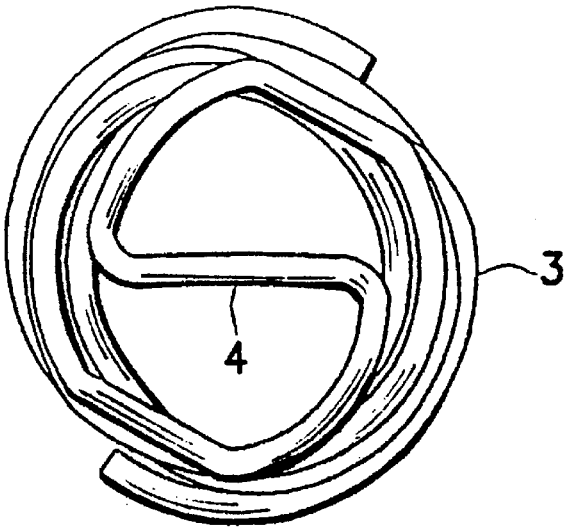
FIG. 3 is a plan view of one of the coil springs.
Figure 4:
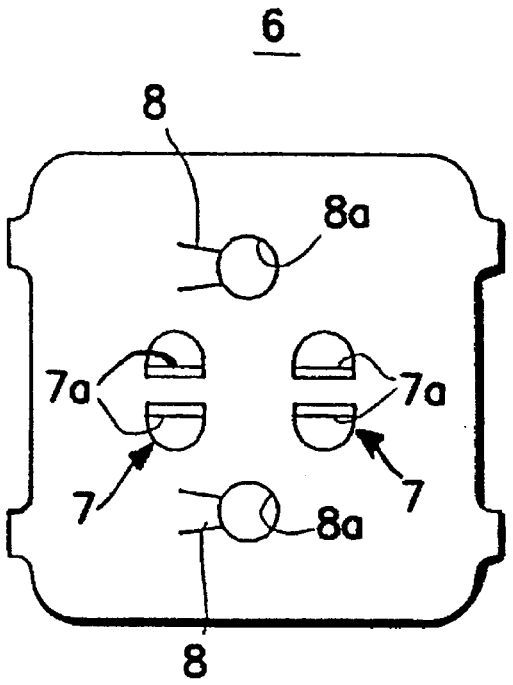
FIG. 4 is a bottom plan view of one of the plate-like elements.
Figure 5:
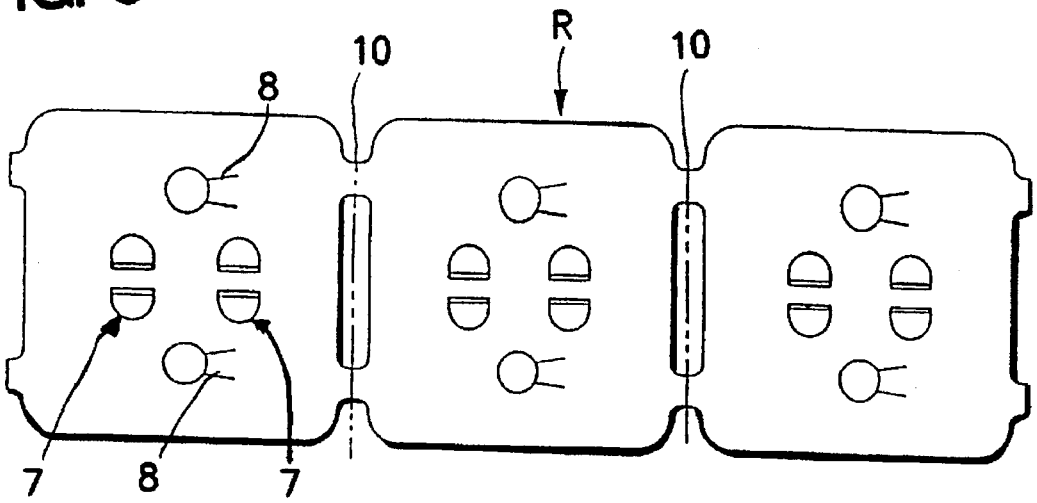
FIG. 5 is a plan view of a strip showing an intermediate stage in the manufacture of the plate-like elements.
Figure 6:
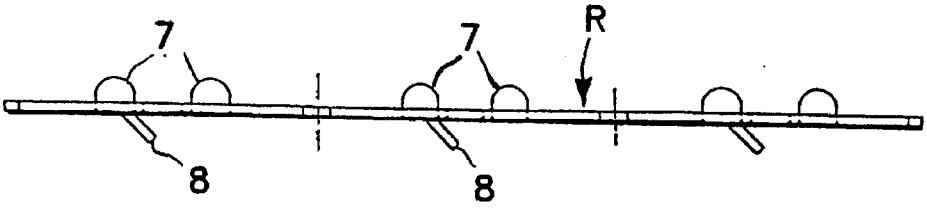
FIG. 6 is a side view of the strip shown in FIG. 5.
Figure 7:
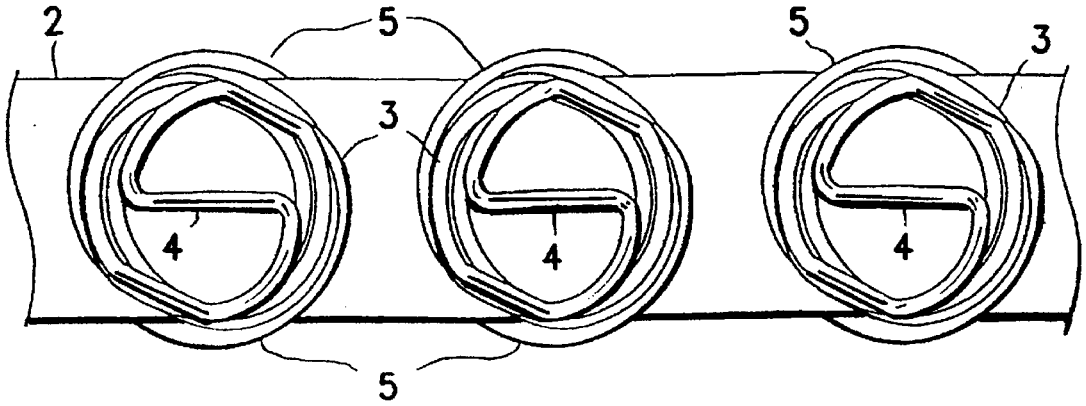
FIG. 7 is a plan view showing the coil springs supported by a backing strip prior to attachment of the plate-like elements.
Figure 8:
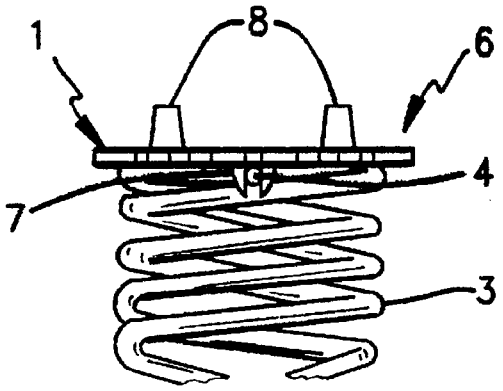
FIG. 8 is a fragmentary end view of another embodiment of a resilient pad according to the invention.
Figure 9:
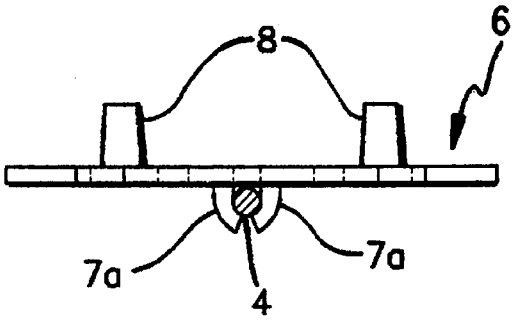
FIG. 9 is an enlarged view of part of the pad shown in FIG. 8.
Figure 10:
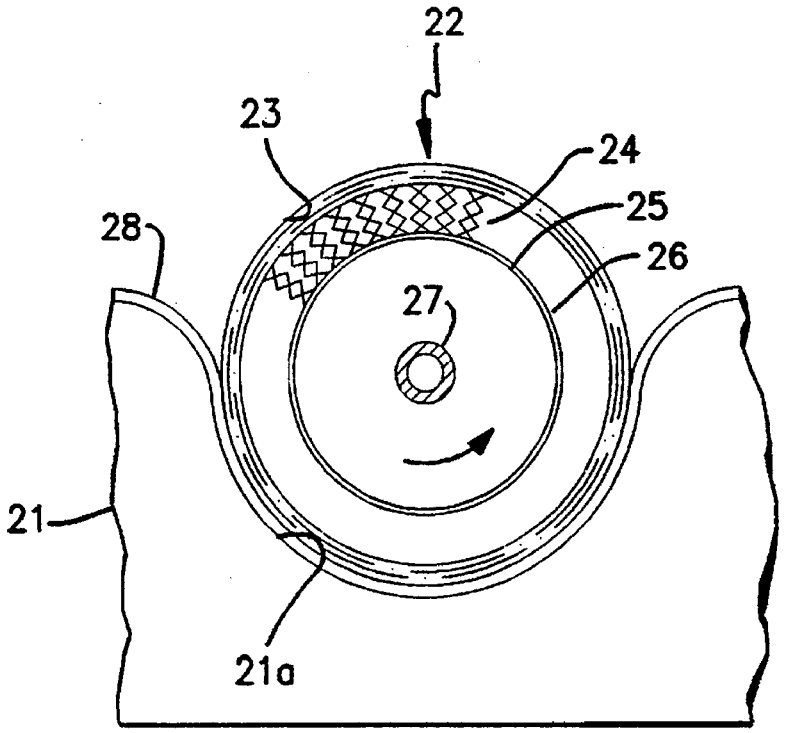
FIG. 10 is a schematic view of a conventional flat sheet ironing machine.
Figure 11:
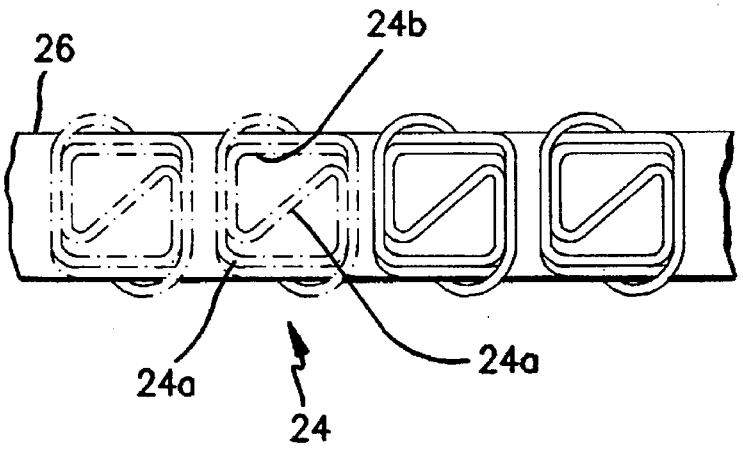
FIG. 11 is a plan view of the springs of the flat sheet ironing machine shown in FIG. 10.

Referring now to FIGS. 1 to 9 of the drawings, the resilient pad 1 shown therein is intended to replace the springs 24 of the conventional flat sheet ironing machine shown in, and described hereinbefore with reference to, FIGS. 10 and 11.

The resilient pad 1 comprises a plurality of helically wound coil springs 3, each having an inner end adjacent to the drum of the ironing machine and an outer end adjacent to the felt cover 9, a backing strip 2 spirally wound about the drum and a plurality of plate-like elements 6 connected respectively to the outer ends of the coil springs 3. The springs 3 are supported in spaced apart relationship along the longitudinal extent of the backing strip 2.

Each coil spring 3 is of bifilary construction having two oppositely wound helical portions joined at the outer end of the spring by a transverse portion 4. The springs 3 are integrally formed with one another from a continuous length of wire. Portions 5 of the wire between adjacent springs 3 pass beneath the backing strip 2 to anchor the inner ends of the springs 3 to the backing strip 2.

The plate-like elements 6 are generally square when viewed in plan and have two spaced apart, outwardly inclined claws 8, which make catching contact with the felt cover 9 to drag the cover 9 round with the drum. The claws 8 are spaced apart perpendicularly of the longitudinal extent of backing strip 2 and are typically inclined at an angle of about 45° to the plane of the plate-like element 6, the free ends of the claws being at the leading edge when the drum is rotated. The plate-like elements 6 also have two spaced apart positioning means 7 for positioning the plate-like element 6 relative to the spring 3. Each positioning means 7 comprises two inwardly extending lugs 7*a* for locating the transverse portion 4 of the spring 3 therebetween.

The two positioning means 7 are located at opposite ends of the transverse portion 4 which is arranged to extend in a direction parallel to the longitudinal extent of the backing strip 2 and perpendicularly to a line joining the two claws 8. To this end, the outermost end of each helically wound portion of each spring, is bent by more than 90° with respect to the transverse portion 4.

Figure 9A:
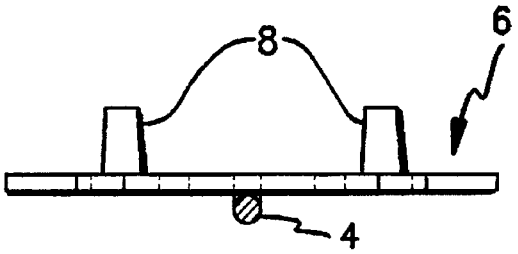
FIG. 9A is a view similar to FIG. 9 but showing a modified embodiment.

Each plate-like element 6 is secured to the transverse portion 4 of a respective spring 3 by welding the lugs 7*a* (and/or the part of the plate-like element intermediate the two pairs of lugs) to the transverse portion 4 or, as shown in FIGS. 8 and 9, by crimping the lugs 7*a* about the transverse portion 4 as shown in FIG. 9. In the latter case, the lugs 7*a* may be of greater length than they need be when welding the plate-like element 6 to the spring 3 as shown in FIG. 9A.

The plate-like elements 6 are made from an elongate strip R. The strip R is stamped to leave adjacent plate-like elements 6 connected to one another by frangible sections 10. Holes 8*a* are punched out so that the claws 8 can be pressed from the strip R without damaging the punch and die. The lugs 7*a* are also pressed from the strip R. The plate-like elements 6 are then separated from one another.

The plate-like elements 6 are then placed on the springs 3, such as by using robots, and connected to the springs 3 by welding or crimping as aforesaid.

The springs 3, backing strip 2 and plate-like elements 6 are all typically formed from stainless steel especially when the water contains large quantities of chlorine, although in some countries, where water quality is high and the water contains low quantities of chlorine, the use of low cost galvanised steel wire for the springs and galvanised steel for the plate-like elements and the backing strip can reduce production costs.

A resilient pad as hereinbefore described has a much greater contact area with the felt than the coil springs used hitherto. The spring pressure is therefore much more evenly distributed on the felt resulting in greater torque and less risk of marking items to be ironed. Also, the provision of the claws provides a simple and inexpensive means of ensuring that the felt is dragged round by the drum and prevents slippage between the felt cover and the resilient pad. It also makes it simpler to replace the felt cover. Indeed, when using a resilient pad as herein described, the felt cover can be replaced by the owner or operator of the flat sheet ironing machine without the need to call out a skilled technician. This avoids any unnecessary down time which could be disastrous to the owner's business and it also saves significant costs. Also, the resilient pad as hereinbefore described is much cheaper to produce than previously used laminated or plate springs and will not be permanently deformed by lumps in items to be ironed.

What is claimed is:

1. A resilient pad for resiliently supporting a felt cover on a rotatable drum of a flat sheet ironing machine, the resilient pad comprising a plurality of helically wound coil springs each having an inner end in use adjacent to the drum and an outer end in use adjacent to the felt cover, a backing strip windable about said drum, the inner end of each coil spring being supported by the backing strip with the coil springs spaced apart along the longitudinal extent of the backing strip, and a plurality of plate-like elements having inner and outer faces and being connected respectively to the outer ends of the coil springs, each coil spring having two helically wound portions joined at the outer end of the spring by a transverse portion which is connected to a respective plate-like element and each plate-like element having one or more claws on its outer surface for making catching contact with the felt cover to ensure that, in use, the felt cover rotates with the drum, wherein each plate-like element has positioning means on its inner face for positioning the plate-like element relative to its respective spring, and wherein each plate-like element has two spaced apart positioning means, one adjacent either end of the transverse portion of the spring.

2. A resilient pad as claimed in claim 1, wherein the springs are integrally formed with one another from a continuous length of wire and wherein portions of the wire between adjacent springs pass beneath the backing strip to anchor the inner ends of the springs to the backing strip.

3. A flat sheet ironing machine comprising a bed having a part cylindrical recess and a roller mounted for rotation in the recess, the roller comprising a drum, a felt cover mounted on the drum and a resilient pad as in claim 1, between the drum and the cover.

4. A flat sheet ironing machine as claimed in claim 3, further comprising means for urging the roller into contact with the bed.

5. A resilient pad for resiliently supporting a felt cover on a rotatable drum of a flat sheet ironing machine, the resilient pad comprising a plurality of helically wound coil springs each having an inner end in use adjacent to the drum and an outer end in use adjacent to the felt cover, a backing strip windable about said drum, the inner end of each coil spring being supported by the backing strip with the coil springs spaced apart along the longitudinal extent of the backing strip, and a plurality of plate-like elements having inner and outer faces and being connected respectively to the outer ends of the coil springs, each coil spring having two helically wound portions joined at the outer end of the spring by a transverse portion which is connected to a respective plate-like element and each plate-like element having one or more claws on its outer surface for making catching contact with the felt cover to ensure that, in use, the felt cover rotates with the drum, wherein each plate-like element has positioning means on its inner face for positioning the plate-like element relative to its respective spring, and wherein the or each positioning means comprises two opposing lugs between which the transverse portion of a respective spring extends.

6. A resilient pad as claimed in claim 5, wherein the plate-like elements are secured to the transverse portions of the respective springs by crimping the lugs about the transverse portions of respective springs.

7. A resilient pad as claimed in claim 5, wherein the springs are integrally formed with one another from a continuous length of wire and wherein portions of the wire between adjacent springs pass beneath the backing strip to anchor the inner ends of the springs to the backing strip.

8. A flat sheet ironing machine comprising a bed having a part cylindrical recess and a roller mounted for rotation in the recess, the roller comprising a drum, a felt cover mounted on the drum and a resilient pad as in claim 5, between the drum and the cover.

9. A flat sheet ironing machine as claimed in claim 8, further comprising means for urging the roller into contact with the bed.

10. A resilient pad for resiliently supporting a felt cover on a rotatable drum of a flat sheet ironing machine, the resilient pad comprising a plurality of helically wound coil springs each having an inner end in use adjacent to the drum and an outer end in use adjacent to the felt cover, a backing strip windable about said drum, the inner end of each coil spring being supported by the backing strip with the coil springs spaced apart along the longitudinal extent of the backing strip, and a plurality of plate-like elements having inner and outer faces and being connected respectively to the outer ends of the coil springs, each coil spring having two helically wound portions joined at the outer end of the spring by a transverse portion which is connected to a respective plate-like element and each plate-like element having one or more claws on its outer surface for making catching contact with the felt cover to ensure that, in use, the felt cover rotates with the drum, wherein the plate-like elements are secured to the transverse portions of respective springs by welding.

11. A resilient pad as claimed in claim 10, wherein the springs are integrally formed with one another from a continuous length of wire and wherein portions of the wire between adjacent springs pass beneath the backing strip to anchor the inner ends of the springs to the backing strip.

12. A flat sheet ironing machine comprising a bed having a part cylindrical recess and a roller mounted for rotation in the recess, the roller comprising a drum, a felt cover mounted on the drum and a resilient pad as in claim 10, between the drum and the cover.

13. A flat sheet ironing machine as claimed in claim 12, further comprising means for urging the roller into contact with the bed.

14. A resilient pad for resiliently supporting a felt cover on a rotatable drum of a flat sheet ironing machine, the resilient pad comprising a plurality of helically wound coil springs each having an inner end in use adjacent to the drum and an outer end in use adjacent to the felt cover, a backing strip windable about said drum, the inner end of each coil spring being supported by the backing strip with the coil springs spaced apart along the longitudinal extent of the backing strip, and a plurality of plate-like elements having inner and outer faces and being connected respectively to the outer ends of the coil springs, each coil spring having two helically wound portions joined at the outer end of the spring by a transverse portion which is connected to a respective plate-like element and each plate-like element having one or more claws on its outer surface for making catching contact with the felt cover to ensure that, in use, the felt cover rotates with the drum, wherein the transverse portions of the springs extend in a direction parallel to the longitudinal extent of the backing strip.

15. A resilient pad as claimed in claim 14, wherein the springs are integrally formed with one another from a continuous length of wire and wherein portions of the wire between adjacent springs pass beneath the backing strip to anchor the inner ends of the springs to the backing strip.

16. A flat sheet ironing machine comprising a bed having a part cylindrical recess and a roller mounted for rotation in the recess, the roller comprising a drum, a felt cover mounted on the drum and a resilient pad as in claim 14, between the drum and the cover.

17. A flat sheet ironing machine as claimed in claim 16, further comprising means for urging the roller into contact with the bed.

* * * * *